US007038140B2

(12) United States Patent
Kuss et al.

(10) Patent No.: US 7,038,140 B2
(45) **Date of Patent: *May 2, 2006**

(54) ELECTRICAL CABLE HAVING A HARDGRADE-EPR INSULATION

(75) Inventors: Jürgen Kuss, Rödental (DE); Burkhard Herpich, Schalkau (DE)

(73) Assignee: Pirelli Kabel & Systeme GmbH & Co. KG, Berlin (DE)

( * ) Notice: Subject to any disclaimer, the term of this patent is extended or adjusted under 35 U.S.C. 154(b) by 0 days.

This patent is subject to a terminal disclaimer.

(21) Appl. No.: 10/823,676

(22) Filed: Apr. 14, 2004

(65) Prior Publication Data

US 2004/0194997 A1 Oct. 7, 2004

Related U.S. Application Data

(63) Continuation of application No. 10/148,417, filed as application No. PCT/EP00/11981 on Nov. 29, 2000, now Pat. No. 6,781,062.

(30) Foreign Application Priority Data

Nov. 30, 1999 (EP) ..... 99123278

(51) Int. Cl.
*H01B 3/00* (2006.01)

(52) U.S. Cl. ..... 174/120 R

(58) Field of Classification Search ..... 174/120 R, 174/121 A, 120 AR, 121 SR, 120 SR
See application file for complete search history.

(56) References Cited

U.S. PATENT DOCUMENTS

| | | | |
|---|---|---|---|
| 3,576,940 A | 5/1971 | Stone et al. | 174/113 |
| 6,781,062 B1 * | 8/2004 | Kuss et al. | 174/120 R |

FOREIGN PATENT DOCUMENTS

| | | |
|---|---|---|
| DE | 20 51 192 | 4/1971 |
| DE | 26 59 541 | 7/1977 |
| DE | 28 00 688 C2 | 7/1978 |
| DE | 28 10 986 A1 | 9/1979 |
| DE | 29 15 188 C2 | 10/1980 |
| DE | 30 07 341 A1 | 9/1981 |
| DE | 30 44 871 C2 | 7/1982 |
| DE | 32 28 119 A1 | 2/1984 |
| DE | 31 37 956 C2 | 8/1988 |
| DE | G 89 07 116.6 | 8/1989 |
| DE | 41 32 390 A1 | 4/1993 |
| DE | G 91 16 636.5 | 6/1993 |
| DE | 44 37 596 A1 | 4/1996 |

(Continued)

OTHER PUBLICATIONS

German Industrial Standard (DIN Deutsche Industrie-Norm) 4102, Section 12, pp. 1-10, Nov. 1998.

(Continued)

*Primary Examiner*—Chau N. Nguyen
(74) *Attorney, Agent, or Firm*—Finnegan, Henderson, Farabow, Garrett & Dunner, L.L.P.

(57) ABSTRACT

An electrical cable having at least one core including a conductor and an insulation surrounding the conductor and having at least two insulation layers. A first one of the layers is a silicone rubber compound and a second one of the layers is an ethylene($C_2$)-alkylene($C_x$)-copolymer or terpolymer mixture adapted to have properties corresponding to those of a hardgrade-ethylene-propylene-rubber (H-EPR). The second layer can be a hardgrade-EPR. Such a cable construction in particular enables reduction of the cable diameter while still being capable of sustaining a burn test according to DIN 4102 Section.

5 Claims, 5 Drawing Sheets

FOREIGN PATENT DOCUMENTS

GB 1117394 1/1970

OTHER PUBLICATIONS

German Industrial Standard (DIN Deutsche Industrie-Norm) VDE 0266, pp. 1-15, Mar. 2000.
German Industrial Standard (DIN Deutsche Industrie-Norm) VDE 0295, pp. 1-9, Jun. 1992.
International Standard, "Power cables with extruded insulation nd their accessories for rated voltages from 1kV ($U_m$= 1,2 kV) up to 30 kV ($U_m$=36 kV)," IEC 60502-1, pp. 1-93 (1998).
"Insulated Electric Cable," Derwent Abstract XP-002136261, Section CH, Week 197910, for JP 54 012491, Jan. 30, 1979.

* cited by examiner

ELECTRICAL CABLE HAVING A HARDGRADE-EPR INSULATION

CROSS REFERENCE TO RELATED APPLICATIONS

This application is a continuation of application Ser. No. 10/148,417, filed Aug. 29, 2002 now U.S. Pat. No. 6,781,062, which in turn is a national stage application of international application number PCT/EP00/11981, filed Nov. 29, 2000, the content of which is incorporated herein by reference, and claims the priority of European Patent Application No. 99123278.6, filed Nov. 30, 1999.

FIELD OF THE INVENTION

The invention relates to an electrical cable having at least one wire including a conductor and an insulation. The insulation surrounds said conductor and comprises at least two insulation layers. Furthermore, the invention also relates to a method for making such an electrical cable.

In particular the invention addresses the problem of making an electrical cable which is lightweight, cost effective and which can still fulfill certain properties when exposed to a burn test where the electrical cable is exposed to a very high temperature under operation. In particular, the insulation should be lightweight and cost effective and should form hard ashes when exposed to the burn test in order to maintain good insulation properties during a high temperature at least over a predetermined period of time.

The electrical cable according to the invention can be used as a power transmission cable or a communication transmission cable depending on the purpose of use.

BACKGROUND OF THE INVENTION

When making an electrical cable having at least one wire including a conductor and an insulation surrounding said conductor and when combining said wires to a cable it is very important to make sure that the insulation fulfills certain mechanical and electrical properties. For example, the insulation materials need to be selected such that environmental influences like very low or very high temperatures or humidity do not change the insulation properties to such an extent that a short circuit would arise.

Furthermore, in buildings or installations where increased safety requirements must be satisfied the cables must be fire-resistant. Every country has established certain industrial standards which must be fulfilled by such cables in this respect. For example, according to the German Industrial Standard (DIN Deutsche Industrie-Norm) 4102 Section 12 cables and wires must sustain temperatures up to 1000° C. over a period of up to 90 minutes according to a unit temperature time curve. During this time a voltage of 400 Volt is applied to the cables and wires and the cables and wires only pass this burn test if no short circuit or conductor interruption occurs.

DESCRIPTION OF THE PRIOR ART

In order to provide cables and wires with appropriate insulation properties conventionally conductors have been provided with a double insulation consisting of at least two insulation layers. As shown in FIG. 1, a conductor 7 is surrounded by a first insulation layer 8 and a second insulation layer 9. Typically the first insulation layer 8 consists of a mica tape which is wound on said conductor 7 the second insulation layer 9 may consist of EPR (ethylene-propylene-rubber). If it is, for example, required that the wire continues an operation over 30 minutes or longer when subjected to the burn test, this will require an insulation thickness of a wire with a cross-section of 1.5 $mm^2$ including a mica tape to be 1.15 mm (thickness of the mica tape 0.15 mm+thickness of the EPR-insulation 1.0 mm). Since a large insulation thickness is required and since mica tape is quite an expensive material this type of cable is comparatively heavy and expensive. For example, if such type of cables are supplied in great length, e.g. on a spool, then the comparatively large insulation thickness will limit the length that can be supplied on the spool. On the other hand, if the cables are heavy then e.g. the masts needed for holding cables during land line operation need to be very stable and therefore the installation costs also rise.

Another type of a cable K is shown in FIG. 2 and also comprises a double insulation arrangement consisting of a first insulation 8' and a second insulation layer 9. Both insulation layers 8', 9 comprise EPR or a silicone rubber compound. Some cables having the construction of FIG. 2 also comprise silicate or even mica as part of the silicone rubber compound. This type of insulation is thicker than the one shown in FIG. 1 and is also cost intensive.

Finally there are also known cables K according to FIG. 3 where the conductor 7 is surrounded by a single layer insulation consisting of hardgrade-EPR. Hardgrade-EPR is a material which has only recently attracted attention and the properties of hardgrade-EPR have been standardized regarding insulation properties, strength etc. For example, the mechanical and electrical properties of hardgrade EPR are defined in IEC 60502.

Furthermore, it may be noted that the mica tape is very cost intensive and it also requires a complicated manufacturing process since the mica tape has to be spun (wound) on the conductor.

FIGS. 4, 5 show conventional constructions of cables comprising a plurality of cores each having core construction according to FIGS. 1, 2. In FIG. 4 the wires are embedded in a common inner sheath 10 which is preferably a fire resistant and halogen free component. Over the inner sheath 10 there is provided a outer sheath coating or cover 11, for example, according to DIN VDE 0266. Conductor 7 consists, for example, of a copper conductor according to DIN VDE 0295 Class 1 or 2, the mica tape consists, for example, of phlogopit and the insulation 9 is a rubber mixture on the basis of EPR according to DIN VDE 0207 E Section 23 mixture type H.

In FIG. 5 a further concentric conductor 12 is provided under the outer sheath 11 and over the common inner sheath 10. The concentric conductor 11 comprises copper filaments including a copper transverse helix.

Constructions as in FIGS. 4, 5 are also possible for the core construction shown in FIG. 3

Published Prior Art

G 91 16 636.5 describes the burn test for cables according to DIN 4102, Section 12. The fire resistant electrical cable comprises two mica tapes wherein a thin layer of a high temperature resistant hard ash forming silicone rubber adhesive is arranged between said two mica tapes.

G 89 02 1116.6 describes a medium voltage or high voltage cable comprising a bandage made of a mica paper band impregnated with silicone resin. An outer conducting layer is also surrounded by a bandage consisting of bands made of mica.

DE 31 379 56 C2 concerns a fire resistant electrical cable having an insulation on a conductor which consists of a polyvinylchloride-mixture. The conductor can also be surrounded by a common layer of silicone rubber. It is described here that at high temperatures the silicone rubber disintegrates and forms powder ashes through which an outer metal layer is held together. The metal layer is a kind of pipe that holds together the ashes in the burn tests.

DE 29 151 88 C2 describes an electrical cable having an insulation consisting of cross-linked polyethylene.

DE 20 51 192 describes a fire resistant electrical cable having an insulation layer and/or an outer layer consisting of magnesium carbonate, chloride and antimon trioxide. The basic component is polyvinylchloride. Several mixtures for the insulation layers are analyzed such as PVC-softeners, stabilizing agents, lubrication means and calcinated kaolin. In particular, ethylene-propylene-rubber (EPR) is used. Only a single insulation layer is mentioned and investigated.

DE 26 59 5415 describes an electrical cable having an insulation made of silicone rubber. A stripe of a polymer/metal-laminate is formed on a conductor and a fire resistant polymer mixture is extruded as outer layer on the surface of said laminate. Therefore, here a double insulation is used.

DE 39 07 341 A1 describes an insulation layer consisting of a mixture of minerals, e.g. silicate or mica. The insulation layer also consists of a binding agent which at least over a predetermined time does not melt in a burn test. An EPR layer is extruded on the mica tape similarly as in the above described FIG. 1. Furthermore, such type of cable is also disclosed in DE 28 10 986.6.

DE 41 32 390 A1 describes an electrical cable having two layers of mica and an outer insulation of an extruded polymer. Furthermore, a high temperature resistant hard ash forming silicone rubber adhesive is used.

DE 44 37 596 A1 describes the use of a hard ash forming silicone rubber fire resistant mixture which contains a silicone compound at least a metal oxide and/or a precursor of said metal oxide and other additives. In particular, it is described that an insulation made of ethylene-propylene-diene-terpolymers (EPDM)-rubber is used. A further insulation layer consists of a non-burnable mineral material such as silicate, glass and hard ash forming silicone rubber. Therefore, this document describes a double insulation made of EPDM and silicate.

DE 28 00 688 C2 describes the use of an EPR-rubber as an outer coating for a cable.

DE 32 28 119 A1 describes a fire resistant cable having conductor insulations consisting of thermal plastic halide free fire resistant polymer mixtures. Over the conductor insulation a foil of glimmer paper is applied.

SUMMARY OF THE INVENTION

As explained above, several types of single or double insulation constructions have been used for insulating the core conductor in cable constructions. However, these insulations consist of mica and EPR or EPDM insulations and therefore are heavyweight and cost intensive due to the large thickness of insulation required.

The present invention aims at avoiding these disadvantages of the prior art. In particular, the object of the present invention is to provide an electrical cable and a manufacturing method therefore such that the electrical cable is lightweight and cost effective.

This object is solved by an electrical cable (claim 1) having at least one core including a conductor and an insulation surrounding said conductor and comprising at least two insulation layers, characterized in that wherein a first one of said layers comprises a silicone rubber compound and a second one of said layers comprises an ethylene ($C_2$)-alkylene($C_x$)-copolymer or terpolymer mixture adapted to have properties corresponding to those of a hardgrade-ethylene-propylene-rubber (H-EPR).

Furthermore, this object is solved by a method (claim 17) for making an electrical cable, comprising the following steps: providing a conductor; forming an insulation comprising at least a first insulation layer and a second insulation layer on said conductor; wherein in said step b) a silicone rubber compound layer is formed as said first insulation layer; in said step b) a layer of an ethylene($C_2$)-alkylene ($C_x$)-copolymer or terpolymer mixture is formed as said second insulation layer; wherein said ethylene($C_2$)-alkylene ($C_x$)-copolymer or terpolymer mixture is provided to have properties corresponding to those of a hardgrade-ethylene-propylene-rubber (H-EPR).

According to the invention, one of the two layers provided on the conductor does not comprise EPR or EPDM as explained above, but it includes an ethylene-alkylene-copolymer or terpolymer mixture which has properties corresponding to those of hardgrade-ethylene-propylene-rubber (hardgrade-EPR).

Whilst according to the invention a preferred material is hardgrade-EPR, the invention comprises one insulation layer which consists in general of an ethylene-alkylene-copolymer or terpolymer mixture whose mixing ratio has been adapted such that the corresponding properties of hardgrade-EPR are achieved. The properties which are achieved are the defined properties regarding the insulation properties and electrical properties.

Preferably (claim 4), the second layer can comprise an ethylene-propylene-copolymer or terpolymer mixture, an ethylene-hexene-copolymer or terpolymer mixture or an ethylene-octene-copolymer or terpolymer mixture.

Preferably (claim 5), the first layer is arranged on said conductor and said second layer made of the ethylene-alkylene-copolymer or terpolymer mixture in arranged on said first layer. However, a different cable construction (claim 6) may preferably comprise the second layer on the conductor 1 and the first layer on the second layer.

Preferably (claim 3), the silicone rubber compound comprises a hard ash forming silicone rubber used for the first layer. Such a silicone compound (claim 10) preferably forms hard ashes during a burn test process.

Preferably (claim 9), the electrical cable constructions according to the invention have properties which allow the cable to conform with the burn test according to the German DIN standard Din 4102 Section 12.

Preferably (claim 11), the electrical cable can comprise a plurality of cores, a sheath surrounding said plurality of cores and an outer coating provided on said sheath. It is also possible (claim 12) that a further conductor is provided under said outer sheath. Preferably (claim 13), the further conductor comprises a plurality of copper filaments.

A particularly advantageous use of the inventive electrical cable (claim 14, 15) is as a communication cable or as a power cable.

Preferably (claim 23), said first layer and said second layer are formed on the conductor by means of an extrusion step. This considerably facilitates the manufacture of the inventive electrical cable.

Preferably (claim 24), the first and second layer are extruded on the respective conductor simultaneously. This can substantially reduce the manufacturing time.

Further advantageous embodiments and improvements of the invention are described in the dependent claims. Furthermore, the invention can comprise embodiments which consist of features which have been described and/or claimed separately in the description and the claims.

Hereinafter, embodiments of the invention will be described with reference to the drawings. It should be noted that the invention is not limited to these embodiments and that the described embodiments only constitute what the inventors presently conceive as best mode of the invention.

BRIEF DESCRIPTION OF THE DRAWINGS

It should be noted that in the drawings the same or similar reference numerals denote the same or similar parts and steps throughout.

PRINCIPLE OF THE INVENTION

Figure 6:
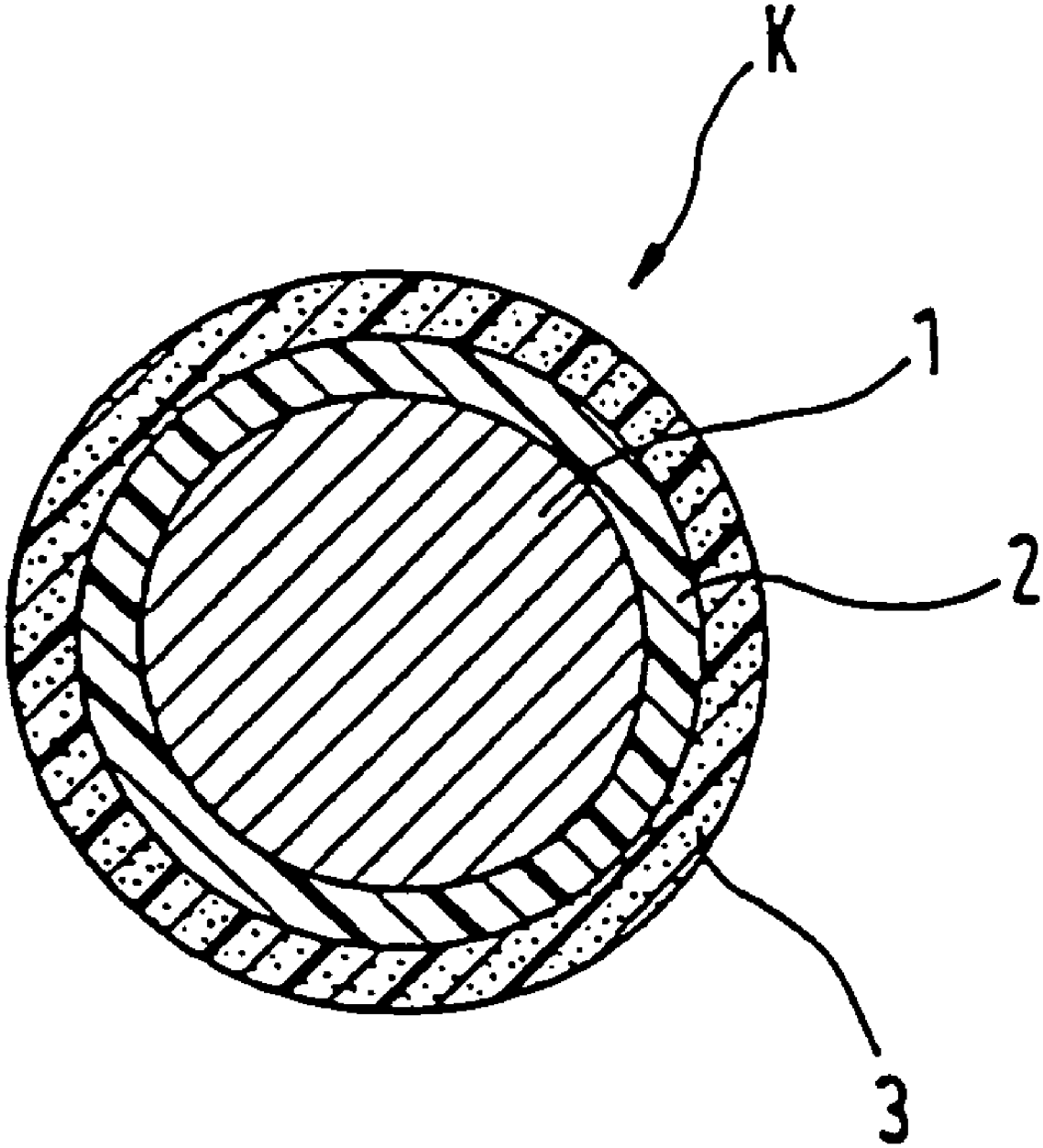
FIG. 6 shows the principal construction of the core having a double insulation according to the invention.

FIG. 6 shows the basic construction of the core K according to the invention. The electrical cable according to the invention has at least one core 1, 2, 3 including a conductor 1 and an insulation 2, 3 surrounding said conductor 1 and comprising at least two insulation layers 2, 3.

According to the invention a first one of said layers, e.g. the layer 2, comprises a silicone rubber compound. According to the invention a second one of the layers 2, 3, e.g. the layer 3, comprises an ethylene ($C_2$)-alkylene ($C_x$)-copolymer or terpolymer mixture adapted to have properties corresponding to those of a hardgrade-ethylene-propylene-rubber (H-EPR).

Figure 1:
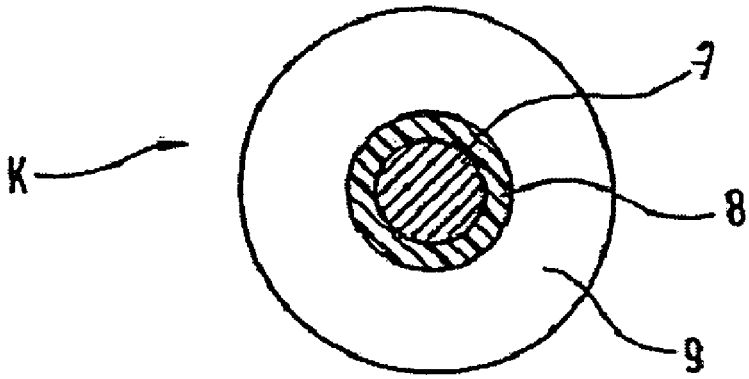
Fig. 1 PRIOR ART
FIG. 1 shows an electrical cable K having a double insulation comprising a tape.
Figure 2:
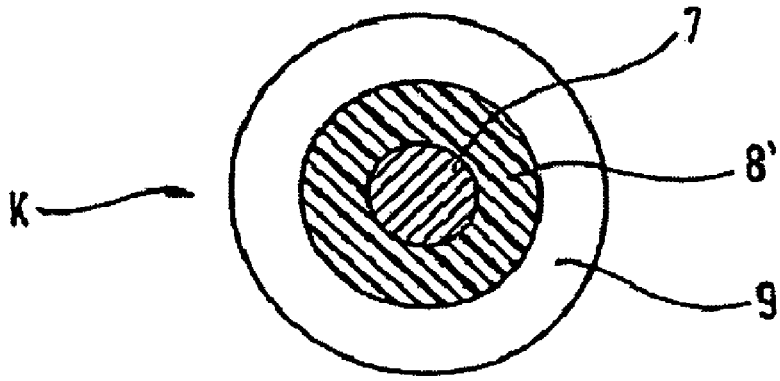
Fig. 2 PRIOR ART
FIG. 2 shows an electrical cable having a double insulation consisting of EPR.
Figure 3:
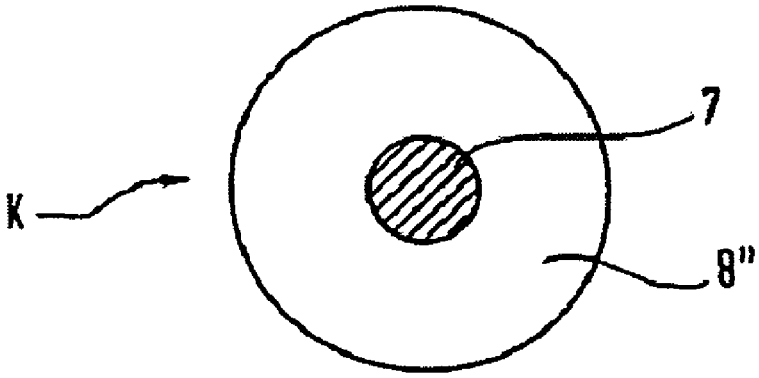
Fig. 3 PRIOR ART
FIG. 3 shows an electrical cable having a single insulation made of hardgrade-EPR.

As shown in FIG. 6, the basic cable construction according to the invention is the double insulation layer construction as in FIG. 1. However, the materials used for the layers, in particular for the layer 3 are different.

In FIG. 6 an embodiment of the invention is shown where the first layer 2 is arranged on said conductor 1 and where said second layer 3 is arranged on said first layer 2. However, it is also possible that the second layer 3 is arranged on said conductor 1 and said first layer 2 is arranged on said second layer 3.

A preferred material for the silicone rubber compound comprises a hard ash forming silicone rubber. The silicone rubber compound can also have additionally mixed into it mica or silica. This provides additional insulation strength in the outer layer 3. In particular, the first layer 2 is made from a silicone compound which forms hard ashes during a burn test process as was explained above. These hard ashes are insulating and do not fall off the conductor 1 during the burn test.

The purpose of the second layer of an ethylene-alkylene-copolymer or terpolymer mixture is to fulfill the mechanical requirements to hardgrade-EPR such that the total insulation thickness of e.g. a wire having a cross section of 1.5 $mm^2$ enduring an operation over 30 minute or longer during said burn test is only 0.7 mm.

Whilst hardgrade-EPR is a preferred mixture of the ethylene-alkylene-copolymer or terpolymer mixture also other ethylene-alkylene-copolymer or terpolymer mixtures can be used. A preferred example comprises $C_2$ (ethylene)-$C_3$ (propylene)-copolymer or terpolymer mixture, a $C_2$ (ethylene)-$C_6$ (hexene)-copolymer or terpolymer mixture or an $C_2$ (ethylene)-$C_8$ (octene)-copolymer or terpolymer mixture. Also combinations of the aforementioned mixtures are possible.

The mechanical/electrical properties of hardgrade-EPR are for example defined in IEC 60502. The most important properties are repeated here for convenience:

| | |
|---|---|
| Tensile strength | min 8.5 MPa |
| Modulus at 150% elongation at break | min 4.5 MPa |
| International Rubber Hardness Degree (IRHD) | min. 80 |

As described above, not only hardgrade-EPR itself fulfills these properties, but also a corresponding mixture consisting of $C_2$–$C_x$ (e.g. x=3, 6, 8) copolymer or terpolymer.

Whilst in the above described example in FIG. 1 the total insulation thickness of the mica tape and of the second EPR-insulation amounts to 1.15 mm, only a total thickness of the double insulation amounting to 0.7 mm is necessary in the invention according to the inventive combination of the first layer 2 consisting of a silicone rubber compound, e.g. a hard ash forming silicone rubber, and the second layer 3 consisting of a $C_2$–$C_x$-copolymer or terpolymer mixture. Since the total insulation thickness is only 0.7 mm (e.g. 0.3 mm for the first layer 2 consisting of the silicone rubber compound +0.4 mm of the second $C_2$–$C_x$-copolymer or terpolymer layer) a number of significant advantages can be achieved. For example, the cross section of a cable comprising 1 to 5 wires having a construction as in FIG. 6 only amounts to 1.5 $mm^2$ to 300 $mm^2$. The total cross section of a cable comprising 6 to 30 wires only amounts to 1.5 $mm^2$ to 4 $mm^2$.

Therefore, the cables K according to the invention are much lighter than previously known cables whilst achieving the desired mechanical and electrical properties. Since less material must be spent the cables K are also more cost effective than the previously known cables. Furthermore, supporting structures for holding the cables, e.g. on land line power transmission lines, only need to support a smaller weight such that the construction of the supporting structure can be made easier and more cost effective. On the other hand, another advantage is that when delivering the cable a longer length of cable can be provided on the same spool or a smaller spool can be used for the same length of cable. A number of other significant advantages are obvious to the skilled person on the basis of the teachings herein.

Despite the reduction in the insulation thickness the cable according to the invention is capable of sustaining the burn test according to DIN 4102 Section 12 of the German Industrial Standard as explained above. That is, during the burn test of 1000° C. over a period from 30–90 minutes the cable could maintain its operation without forming a short circuit. During the burn test the silicone compound (e.g. the hard ash forming silicone rubber) forms hard ashes which are held together such that the insulation is maintained whilst the hardgrade-EPR still protects the hard ashes as a kind of pipe. Despite the reduction of wall thickness the same operation properties and insulation properties can therefore be achieved.

Preferably, all materials used in the layers 2, 3 in FIG. 6 are free of halogene such that during the burn test or any burning of the cable no hydrochloric acid (HCL) is formed.

First Embodiment

Whilst FIG. 1 shows the basic core construction only having one core consisting of the conductor 1 and two insulation layers 2, 3, a number of advantageous embodiments of cable constructions can be provided by the skilled person.

Figure 4:
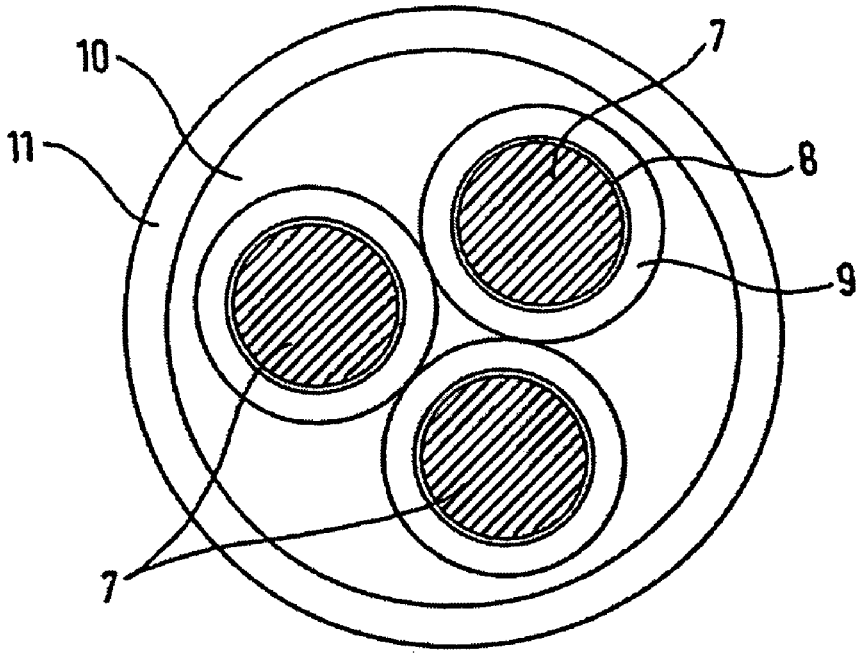
Fig. 4 PRIOR ART
FIG. 4 shows an electrical cable comprising several wires embedded in a inner sheath and surrounded by an outer sheath.
Figure 5:
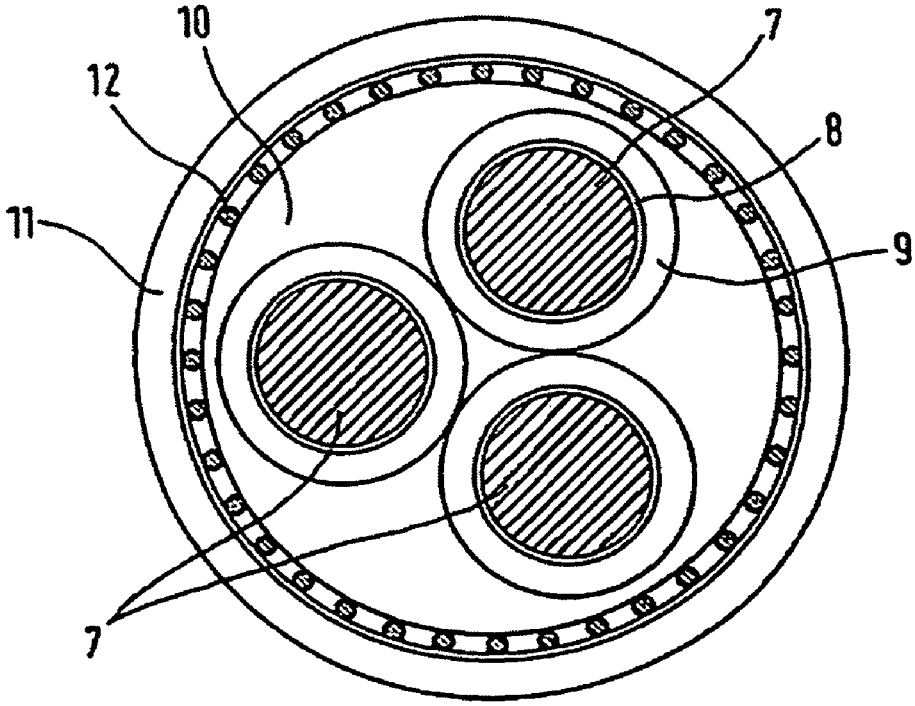
Fig. 5 PRIOR ART
FIG. 5 shows an electrical cable according to FIG. 4 with an additional conductor layer provided underneath the outer sheath.
Figure 7A:
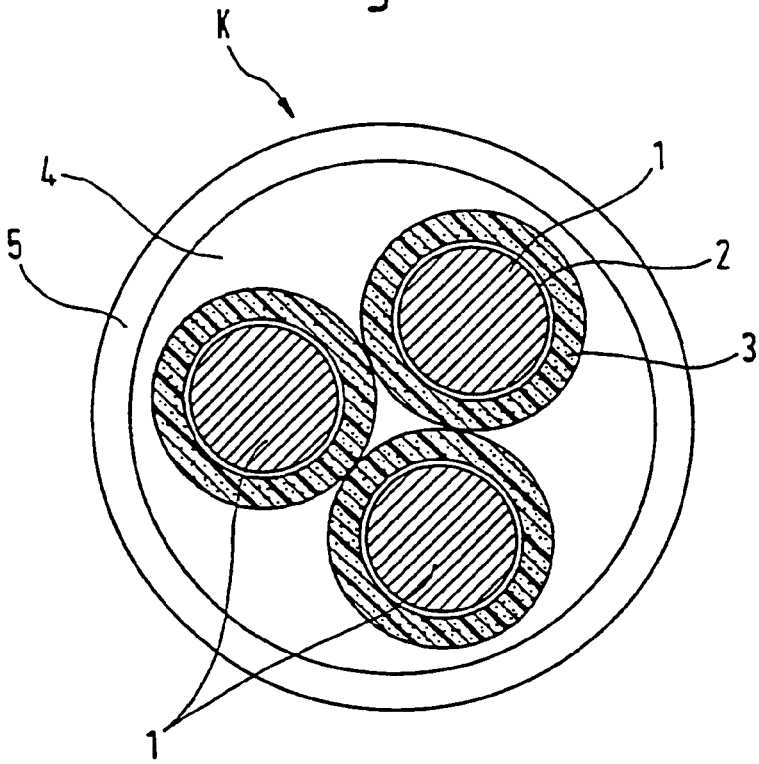
FIG. 7*a* shows the cable construction including a plurality of wires according to the invention in a cross-sectional view.
Figure 7B:
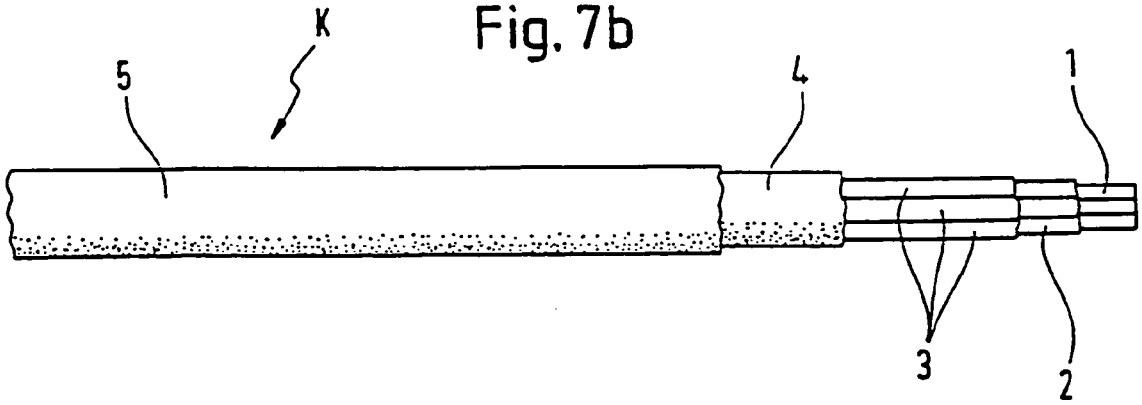
FIG. 7*b* shows the cable construction according to FIG. 7*a* in a side-view.

FIG. 7*a* shows the first embodiment of a cable construction comprising a plurality of cores each having a construction as shown in FIG. 6. A sheath 4 surrounds said plurality of cores and an outer sheath 5 is provided on said sheath 4. FIG. 7*b* shows a longitudinal view of the cable construction in FIG. 7*a*. Since the individual cores have a smaller total diameter due to the usage of the inventive double insulation, a greater number of cores can be arranged in the sheath 5 when it has the same diameter as the construction in FIG. 4 or using the same number of cores the total diameter of the cable K can be reduced.

Second Embodiment

Figure 8A:
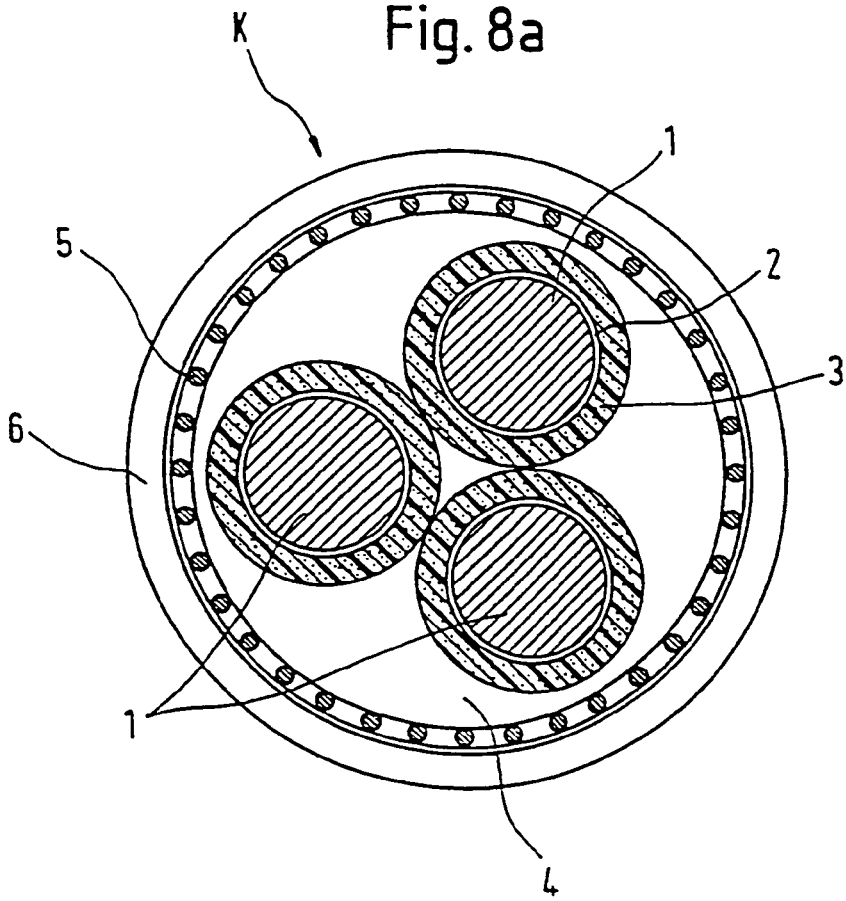
FIG. 8*a* shows an electrical cable comprising a plurality of wires according to the invention including an additional conductor layer underneath the outer sheath.
Figure 8B:
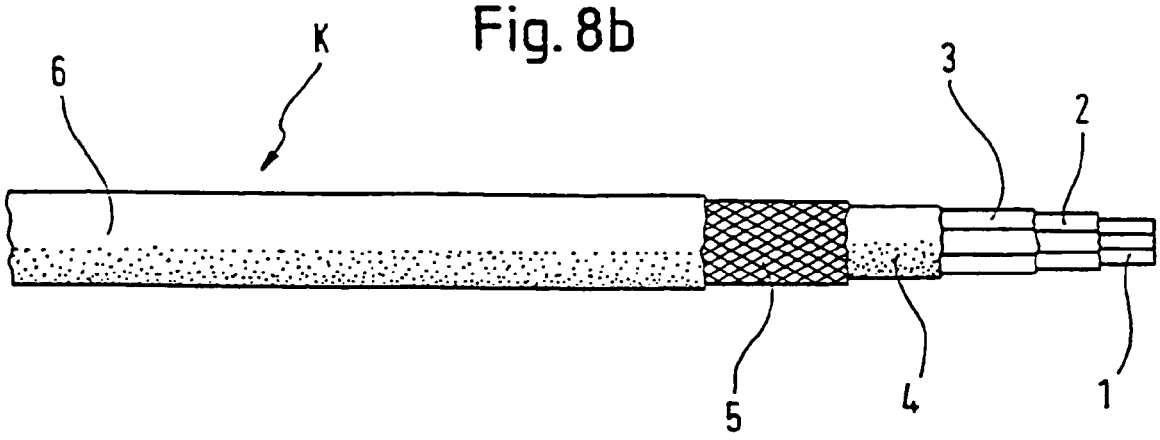
FIG. 8*b* shows the cable construction of FIG. 8*a* longitudinally.

FIG. 8*a* shows a second embodiment of a cable K comprising cores constructions as shown in FIG. 6. Here, a further conductor 5 is provided underneath said outer sheath 6. Said further conductor can comprise a plurality of spiral copper wires. FIG. 8*b* shows a longitudinal view of the cable construction K shown in cross-section in FIG. 8*a*.

The conductor 1 can be a copper conductor according to DIN VDE 0295 class 1 or 2. The sheath 6 can be a halogene free fire resistant mixture according to DIN VDE 0266.

Whilst FIG. 7 and FIG. 8 only show preferred examples of cable constructions according to the invention, the skilled person can derive other cable constructions including wires having the basic construction as in FIG. 6 on the basis of the teachings contained herein.

Third Embodiment

As explained above, according to the invention the cores of the inventive cable K consist of the conductor and the double insulation layer. When such an electrical cable K is manufactured, the conductor 1 is provided, a first insulation layer 2 consisting of the silicone rubber compound is provided on the layer 1 and the second layer 3 of $C_2$–$C_x$-copolymer or terpolymer mixture is formed on said first layer 2 wherein the $C_2$–$C_x$-copolymer or terpolymer mixture is prepared beforehand to have properties corresponding to those of a hardgrade-ethylene-propylene-rubber.

Independent as to whether the second layer 3 is formed on said conductor and said first layer 2 on said second layer or said first layer 2 is formed on said conductor 1 and said second layer 3 is formed on said first layer 2, it should be noted that the first and second layers 2, 3 are extruded onto the conductor 1.

According to a preferred embodiment of the manufacturing method of the invention the first and second layer 2, 3 are extruded on the conductor 1 simultaneously. However, it is also possible to first provide one layer via an extrusion step and then provide the second layer via an extrusion step.

INDUSTRIAL APPLICABILITY

As described above, the electrical cable construction according to the invention provides major advantages in any installation where the cable is used since it is more cost effective, has lower weight and can still sustain the burn test which in particular required for power transmission cables.

However, the electrical cable according to the invention can also be used not only in power transmission lines but also as a communication cable.

Furthermore, it should be noted that a skilled person can derive further variations and modifications of the embodiments on the basis of the teachings contained herein. In particular, it should be noted that the above described embodiments are only what the inventors presently conceive as best mode of the invention. Furthermore, the invention can comprise embodiments which consist of features which have been described separately in the description and the claims. Therefore, it is intended that all embodiments, variations and modifications fall within the scope of the attached claims.

In the claims, reference numerals only serve clarification purposes and do not limit the scope of protection.

The invention claimed is:

1. An electrical cable having at least one core including at least one conductor and an insulation surrounding said conductor, said insulation comprising at least two insulation layers, a first insulation layer comprising a silicone rubber compound and a second insulation layer comprising an ethylene ($C_2$)-propylene ($C_3$)-copolymer or terpolymer mixture, an ethylene($C_2$)-hexene($C_6$)-copolymer or terpolymer mixture or an ethylene($C_2$)-octene($C_8$)-copolymer or terpolymer mixture, the cable further having an outer sheath comprising a halogen-free fire resistant mixture.

2. An electrical cable having at least one core including at least one conductor and an insulation surrounding said conductor, said insulation comprising at least two insulation layers, a first insulation layer comprising a silicone rubber compound and a second insulation layer comprising an ethylene ($C_2$)-alkylene ($C_x$)-copolymer or terpolymer mixture adapted to have properties corresponding to those of a hardgrade-ethylene-propylene-rubber (H-EPR), the cable further having an outer sheath comprising a halogen-free fire resistant mixture, wherein said first insulation layer is arranged on said conductor and said second insulation layer is arranged on said first insulation layer.

3. An electrical cable having at least one core including at least one conductor and an insulation surrounding said conductor, said insulation comprising at least two insulation layers, a first insulation layer comprising a silicone rubber compound and a second insulation layer comprising an ethylene ($C_2$)-alkylene ($C_x$)-copolymer or terpolymer mixture adapted to have properties corresponding to those of a hardgrade-ethylene-propylene-rubber (H-EPR), the cable further having an outer sheath comprising a halogen-free fire resistant mixture, wherein said conductor comprises one or more wires wherein further a cross sectional area of said cable is in the range of 1.5 $mm^2$ to 300 $mm^2$ if said conductor comprises 1 to 5 wires and is in the range of 1.5 $mm^2$ to 4 $mm^2$ if said conductor comprises 6 to 30 wires.

4. An electrical cable having at least one core including at least one conductor and an insulation surrounding said conductor, said insulation comprising at least two insulation layers, a first insulation layer comprising a silicone rubber compound and a second insulation layer comprising an ethylene ($C_2$)-alkylene ($C_x$)-copolymer or terpolymer mixture adapted to have properties corresponding to those of a hardgrade-ethylene-propylene-rubber (H-EPR), the cable further having an outer sheath comprising a halogen-free fire resistant mixture, wherein a cross-sectional area of said conductor is 1.5 $mm^2$, a thickness of said first insulation layer is 0.3 mm and a thickness of said second insulation layer is 0.4 mm.

5. A method for making an electrical cable, comprising:

forming on a conductor a first insulation layer and a second insulation layer; and forming a sheath comprising a halogen-free fire resistant mixture, wherein said second insulation layer comprises an ethylene($C_2$)-propylene($C_3$)-copolymer or terpolymer mixture, an ethylene($C_2$)-hexene($C_6$)-copolymer or terpolymer mixture or an ethylene($C_2$)-octene($C_8$)-copolymer or terpolymer mixture.

* * * * *